US005888687A

United States Patent [19]

Matsumura et al.

[11] Patent Number: 5,888,687

[45] Date of Patent: Mar. 30, 1999

[54] TONER FOR DEVELOPING ELECTROSTATIC CHARGE IMAGE, PRODUCTION METHOD THEREOF, AND IMAGE FORMATION METHOD

[75] Inventors: Yasuo Matsumura; Manabu Serizawa; Masaaki Suwabe; Shuji Sato; Yasuo Kadokura, all of Minami-ashigara, Japan

[73] Assignee: Fuji Xerox Co., Ltd., Tokyo, Japan

[21] Appl. No.: 917,076

[22] Filed: Aug. 25, 1997

[30] Foreign Application Priority Data

Aug. 30, 1996 [JP] Japan ..... 8-230503

[51] Int. Cl.[6] ..... G03G 9/087

[52] U.S. Cl. ..... 430/110; 430/137

[58] Field of Search ..... 430/137, 126, 430/110

[56] References Cited

U.S. PATENT DOCUMENTS 5,591,556 1/1997 Shimomura et al. ..... 430/137

5,766,817 6/1998 Cheng et al. ..... 430/137

FOREIGN PATENT DOCUMENTS

A-63-282752 11/1988 Japan .

A-6-250439 9/1994 Japan .

*Primary Examiner*—John Goodrow

*Attorney, Agent, or Firm*—Oliff & Berridge, PLC

[57] ABSTRACT

The present invention relates to a production method of a toner for developing an electrostatic charge image having an excellent charging property, the method comprising the steps of: forming aggregative particles in a dispersion including at least dispersed resin particles to prepare an aggregative particle dispersion; adding a resin-containing fine particle dispersion containing dispersed resin-containing fine particles into the aggregative particle dispersion and mixing therewith to form adhered particles having said resin-containing fine particles adhering to said aggregative particles; and heating said adhered particles to be fused, wherein concentration of a dissociation group of said resin-containing particles per unit volume is lower than that of a dissociation group of said resin-containing fine particles per unit volume.

13 Claims, No Drawings

TONER FOR DEVELOPING ELECTROSTATIC CHARGE IMAGE, PRODUCTION METHOD THEREOF, AND IMAGE FORMATION METHOD

BACKGROUND OF THE INVENTION

1. Field of the Invention

The present invention relates to a toner for developing an electrostatic charge image, which is excellent in various characteristics including a charging property and is suitably used during formation of an image using an electrophotographic method, a method for efficiently producing the toner for developing an electrostatic charge image, and an image formation method using the toner for developing an electrostatic charge image.

2. Description of the Related Art

Methods for visualizing image information via an electrostatic charge image, such as an electrophotographic method, are widely used in various fields. In the electrophotographic method, an electrostatic charge image is formed on a photoreceptor via a charging process, an exposure process, etc. The electrostatic charge image is developed with a developer containing toner particles, and visualized via a transfer step, a fixing process, etc.

As the developer, two-component-type image developers containing toner particles and carrier particles, and one-component-type developers containing magnetic toner particles or nonmagnetic toner particles are known. Toner particles in the developer are usually produced in a kneading and pulverizing method. In the kneading and pulverizing method, a thermoplastic resin is melted and kneaded with a pigment, a charge controller, and a mold release agent such as a wax. After cooling, the melted and kneaded product is finely pulverized and classified to produce desired toner particles. In order to improve the flowability and cleaning property of the toner particles produced by the kneading and pulverizing method, inorganic and/or organic fine particles can be further added to the surface thereof as needed.

Toner particles produced in the kneading and pulverizing method usually have an amorphous shape without a homogeneous surface composition. Although the shape and surface composition of toner particles change slightly depending upon the pulverizability of the used material and conditions of the pulverizing process, it is difficult to intentionally control these elements to a desired degree. In addition, in the case of toner particles produced in the kneading and pulverizing method with a material with a particularly high pulverizability, due to mechanical forces in the developing device such as shearing force, it is often the case that the particles are pulverized still more finely or the shape thereof is altered. As a consequence, problems occur in the case of the two-component-type developer, the pulverized toner particles adhere to the carrier surface so that the charge deterioration of the developer is accelerated, and in the case of the one-component-type developer, the particle size distribution is expanded so that the pulverized toner particles scatter or the developing property is lowered according to the change of the toner shape, resulting in a deteriorated image quality.

In a case in which the toner particles have an amorphous shape, there is a problem that, even though a flowability aid is added, the flowability is insufficient and the fine particles of the flowability aid are moved to the concave portions of the toner particles to be buried therein during operation due to mechanical force such as shearing force, and thus flowability decreases over time or the developing property, transfer property, and cleaning property deteriorate. Furthermore, there is a problem that, by recycling the toner through recollection and cleaning treatment to return to the developer, it tends to deteriorate image quality. In order to prevent these problems, further increase of the amount of the flowability auxiliary agent can be considered; however, this involves problems in that generation of spots on the photoreceptor and particle scattering of the flowability auxiliary agent occur.

On the other hand, in a case of a toner containing a mold release agent such as a wax, the mold release agent may be exposed on the toner particle surface depending upon the combination with a thermoplastic resin. Particularly in the case of a toner combining a resin applied with elasticity by a high molecular weight component not easily pulverized and a vulnerable wax such as polyethylene, polyethylene exposure on the toner particle surface is often observed. Although such a toner has an advantageous mold releasing property at fixing or cleaning of untransferred toner on the photoreceptor, there is a problem since polyethylene on the surface of the toner particles easily fall off toner particles due to the mechanical force in the developing device such as shearing force and transfer to the developing roller, the photoreceptor, the carrier, etc., causing dirt that decreases the reliability of the developer.

Under such circumstances, nowadays, as a means for producing a toner whose particle shape and the surface composition are intentionally controlled, an emulsion polymerization aggregation method is proposed in Japanese Patent Application Laid-Open (JP-A) Nos. 63-282752 and 6-250439. The emulsion polymerization aggregation method is for obtaining toner particles by preparing a resin dispersion by emulsion polymerization and a colorant dispersion where a colorant is dispersed in a solvent, mixing for forming aggregative particles corresponding to the toner particle size, and heating for fusing. According to the emulsion polymerization aggregation method, the toner shape can be optionally controlled from amorphous to spherical by the selection of the heating temperature condition.

However, in the case of the emulsion polymerization aggregation method, since aggregative particles in a homogeneous mixing state are fused, the composition of the toner is homogeneous from the inside to the surface, and thus it is difficult to intentionally control the structure and composition of the toner particle surface. Particularly in the case the aggregative particles contain a mold release agent, the mold release agent exists on the toner particle surface after fusing so that filming generation and burial of the external additive used for the sake of flowability inside the toner may occur.

In order to maintain and pursue stable toner performance under various mechanical stresses in an electrophotography process, it is necessary to constrain the exposure of a mold release agent on the toner particle surface, to improve the surface hardness of the toner particle, and to further improve the smoothness of the toner particle surface. Although the mold release agent may cause various problems if it is exposed on the toner particle surface, it is preferable that it be near the toner particle surface in consideration of the toner performance at fixing.

Recently, owing to the need for higher image quality, particularly in color image formation, toners of a smaller size have been developed for realizing finer images. However, with conventional toner particle distribution, merely with a smaller size, it is difficult to simultaneously realize both high image quality and high reliability due to significant problems of dirt on a carrier or a photoreceptor and toner scattering due to finer toner particles. In order to realize high image quality and high reliability at the same time, a sharper toner particle distribution and a smaller particle size are needed.

SUMMARY OF THE INVENTION

An object of the present invention is to solve the various conventional problems by providing the following to control the structure and composition of toner particles from the surface to the inside.

1. A toner for developing an electrostatic charge image having excellent characteristics including a charging property, a developing property, transfer property, fixing property, and cleaning property, the charging property being particularly excellent.
2. A toner for developing an electrostatic charge image having high reliability, capable of stably maintaining and exhibiting the above-mentioned characteristics, particularly the charging property, without being affected by environmental conditions.
3. A toner for developing an electrostatic charge image which is suitably used for a two-component-type electrostatic charge image developer having a high transfer efficiency, low toner consumption, and long life.
4. A production method of a toner for developing an electrostatic charge image, which is capable of easily and conveniently producing the toner for developing an electrostatic charge image having the excellent above-mentioned characteristics.
5. An image formation method capable of easily and conveniently forming a full-color image having high image quality and high reliability.
6. An image formation method capable of obtaining high image quality in a so-called cleanerless system in which a cleaning mechanism is unnecessary.
7. And an image formation method capable of adjusting to a so-called toner recycling system where a toner collected from a cleaner is reused to obtain high image quality.

The means provided by the present invention to solve the above-mentioned problems are described below.

The first means is a production method of a toner for developing an electrostatic charge image which comprises a step in which an aggregative particle dispersion is prepared by forming aggregative particles in a dispersion including at least the first resin particles dispersed therein (hereinafter referred to as the first step), a step in which adhered particles are formed by adding a resin-containing fine particle dispersion containing the second dispersed fine particles into the aggregative particle dispersion and mixing therewith so as to have the second resin-containing fine particles adhere to the aggregative particles (hereinafter referred to as the second step), and a step in which the adhered particles are heated so as to be fused (hereinafter referred to as the third step), wherein the concentration of a second dissociation group in the second resin-containing fine particles per unit weight is lower than that of a first dissociation group in the first resin-containing fine particles per unit weight.

In the above-mentioned production method of a toner for developing an electrostatic charge image, it is preferable that the first dissociation group and the second dissociation group are independently selected from a carboxyl group, a sulfonic group, and an ammonium group. More preferably, these dissociation groups are of the same type. It is preferable that the first resin particles and the second resin-containing fine particles each comprise, as a monomer component, a vinyl type resin or a vinyl type high polymer acid. The aggregate particles preferably comprise a colorant or a mold release agent. Further, the second resin-containing fine particles have a glass transition point higher than that of the first resin particles, the average particle size thereof is 1 $\mu$m or less, or the volume thereof is 50% or less of the volume of the toner particles for developing an electrostatic charge image.

The second means is a toner for developing an electrostatic charge image produced by the above-mentioned first means production method of a toner for developing an electrostatic charge image.

The third means is an image formation method comprising the steps of forming an electrostatic latent image on an electrostatic latent image holding member, developing the electrostatic latent image with a developer layer on a developer carrying member to form a toner image, and transferring the toner image onto a transfer body, wherein the developer layer comprises the above-mentioned toner for developing an electrostatic charge image described in claim 10.

The above-mentioned image formation method preferably comprises a cleaning step in which toner remaining on the electrostatic latent image holding member is collected after the transfer step, and preferably a recycling step in which the toner for developing an electrostatic charge image collected in the cleaning step is transferred to the developer layer.

The present invention can solve the above long-standing, various problems.

Furthermore, through the present invention, there can be provided a toner for developing an electrostatic charge image having excellent properties including charging properties, developing property, transfer property, fixing property, and cleaning property, the charging property being particularly excellent, capable of stably maintaining and exhibiting the above-mentioned properties, particularly, the charging property without being affected by environmental conditions, and having high reliability. Further, through the present invention, a toner for developing an electrostatic charge image which is suitable for a two-component-type electrostatic charge image developer having a high transfer efficiency, low toner consumption, and long life can be provided. Moreover, through the present invention, there can also be provided a production method of a toner for developing an electrostatic charge image which is capable of producing the above-mentioned toner for developing an electrostatic charge image having excellent properties easily and conveniently. In addition, through the present invention, an image formation method capable of easily and conveniently forming a full-color image at high image quality and high reliability can be provided. The image formation method of the present invention is highly suitable both for a cleanerless system and for a toner recycle system, and provides high image quality easily.

DESCRIPTION OF THE PREFERRED EMBODIMENTS

Production Method of a Toner for Developing an Electrostatic Charge Image

According to the production method of the toner for developing an electrostatic charge image of the present invention, in the first step, the first resin particles contained in the dispersion aggregate to form the aggregative particles. In the second step, the adhered particles are formed by adding a resin-containing fine particle dispersion containing dispersed fine particles into the aggregative particle dispersion and mixing therewith so as to have the second resin-containing fine particles adhere to the surface of the aggregative particles (mother particles). The above-mentioned aggregative particles and adhered particles are each formed by, for example, hetero aggregation, and are formed in such a manner that with amounts of ionic surfactants contained in dispersions added and mixed as described above being previously unbalanced, each of the dispersions is added so as to compensate for an offset of the amounts. In the third step, a resin in the adhered particles is melted and then fused and toner particles for developing an electrostatic charge image are thereby formed.

At this time, the concentration of the second dissociation group in the above-mentioned second resin-containing fine particles per unit weight is lower than that of the first dissociation group in the first resin particles per unit weight, and therefore, the concentration of the dissociation group on the surface of the above-mentioned aggregative particles is relatively high. For this reason, the aggregative particles are easily formed and the particle size distribution thereof is also controlled. On the other hand, the concentration of the dissociation group on the surface of the toner particles for developing an electrostatic charge image is relatively low, and therefore, absorption and dehydration of water is not easily caused. As a result, the toner particles for developing an electrostatic charge image allow simple cleaning, have excellent charging properties, and maintain such characteristics, particularly the charging properties, under most environmental conditions.

A production method of a toner for developing an electrostatic charge image of the present invention comprises a first step, a second step, and a third step.

First Step

The first step comprises a step in which an aggregative particle dispersion is prepared by forming aggregative particles in a dispersion (hereinafter, the first step may be referred to as an "aggregation step").

The dispersion comprises at least dispersed resin particles.

The resin particles comprise particles made from a resin.

As an example of the resin, a thermoplastic binder resin may be used. Concrete examples include homopolymers or copolymers of styrenes (styrene-containing resin), such as styrene, parachloro styrene, and α-methyl styrene; homopolymers or copolymers of esters (vinyl-containing resin) having a vinyl group, such as methyl acrylate, ethyl acrylate, n-propyl acrylate, n-butyl acrylate, lauryl acrylate, 2-ethyl hexyl acrylate, methyl methacrylate, ethyl methacrylate, n-propyl methacrylate, lauryl methacrylate, and 2-ethyl hexyl methacrylate; homopolyers or copolymers of vinyl nitrites (vinyl-containing resin), such as acrylonitrile, and methacrylonitrile; homopolymers or copolymers of vinyl ethers (vinyl-containing resin), such as vinyl methyl ether, and vinyl isobutyl ether; homopolymers or copolymers of vinyl ketones (vinyl-containing resin), such as vinyl methyl ketone, vinyl ethyl ketone, and vinyl isopropenyl ketone; homopolymers or copolymers of olefins (olefin-containing resin), such as ethylene, propylene, butadiene, and isoprene; and nonvinyl condensation-containing resins, such as an epoxy resin, a polyester resin, a polyurethane resin, polyamide resin, a cellulose resin, and a polyether resin, and graft copolymers of nonvinyl condensation-containing resins and a vinyl-containing monomer. These resins can be used alone or in a combination of two or more.

Among these resins, vinyl type resins are particularly preferable. The vinyl type resins are advantageous in that the resin-containing particle dispersion is easily prepared by emulsion polymerization or seed polymerization through the use of an ionic-type surfactant.

Examples of the above-mentioned vinyl type monomer include monomers from which a vinyl type high-polymer acid or a vinyl type high polymer base is formed. For example, acrylic acid, methacrylic acid, maleic acid, cinnamic acid, fumaric acid, vinyl sulfonic acid, ethyleneimine, vinylpyridine, and vinylamine. In the present invention, it is preferable that the above-mentioned resin particles contain the above-mentioned vinyl type monomer as a monomer component. In the present invention, among these vinyl type monomers, a vinyl type high polymer acid is preferably used because of the simplicity of the formation reaction of a vinyl type resin. More specifically, a dissociative vinyl type monomer having a carboxyl group as a dissociation group, for example, acrylic acid, methacylic acid, maleic acid, cinnamic acid, and fumaric acid is particularly preferable in consideration of the control of the degree of polymerization or glass transition point exhibited.

An average particle size of the resin particles is, in general, 1 μm or less, and preferably 0.0 1 to 1 μm. An average resin particle size exceeding 1 μm causes a broader particle size distribution of a toner for developing an electrostatic charge image finally obtained or generates free radical particles, and thus easily causes deterioration of performance or reliability. On the other hand, an average particle size within the above-mentioned range eliminates the above-mentioned problems, toners can be spread more evenly so that the state of dispersion in the toners is improved, and thus it is advantageous in that irregular performance or reliability is alleviated. The average particle size may be measured with a Coulter counter.

In a case in which a resin-containing fine particle dispersion does not contain a colorant in the second step of the present invention described hereinafter, it is further necessary to have a colorant dispersed in the above-mentioned dispersion. In this case, a colorant may be dispersed in the resin particle dispersion, or a colorant dispersion may be mixed with the resin particle dispersion.

Examples of the colorant include pigments, such as carbon black, chrome yellow, hanza yellow, bendizine yellow, threne yellow, quinoline yellow, permanent orange GTR, pyrazolone orange, vulcan orange, watchung red, permanent red, brilliant carmine 3B, brilliant carmine 6B, Du Pont oil red, pyrazolone red, lithol red, rhodamine lake B, lake red C, rose iron oxide red, aniline blue, ultra marine blue, chalco oil blue, methylene blue chloride, phthalocyanine blue, phthalocyanine green, and malachite green oxalate; and dyes, such as acridine type, xanthene type, azo type, benzoquinone type, adine type, anthraquinone type, dioxadine type, thiazine type, azomethine type, indigo type, thioindigo type, phthalocyanine type, aniline black type, polymethine type, triphenyl methane type, diphenyl methane type, thiazine type, thiazole type, and xanthene type. These colorants may be used alone or in combination of two or more.

An average particle size of the colorant is, in general, 1 μm or less, and preferably 0.01 to 1 μm. An average colorant particle size exceeding 1 μm causes a broader particle size distribution of a toner for developing an electrostatic charge image finally obtained or generates free radical particles, and thus easily causes deterioration of performance or reliability. On the other hand, an average particle size within the above-mentioned range eliminates the above-mentioned problems, toners can be spread more evenly so that the state of dispersion in the toners is improved, and thus it is advantageous in that irregular performance or reliability is alleviated. The average particle size may be measured with a Coulter counter.

If both colorant and resin particles are used in the dispersion, the combination is not specifically limited and thus it can be selected optionally according to the purpose.

In the present invention, other components such as a mold release agent, an internal additive, a charge controller, inorganic particles, a lubricant, and an abrasive may be dispersed in the above-mentioned dispersion according to the purpose. In this case, the other particles may be dispersed in the resin particle dispersion, or a dispersion of other particles may be mixed with the resin particle dispersion.

Examples of the mold release agent include low-molecular-weight polyolefins, such as polyethylene, polypropylene, and polybutene; silicones having a softening point induced by heating; aliphatic amides, such as amide oleate, amide erucate, amide ricinolate, and amide stearate; plant waxes, such as carnauba wax, rice wax, canderira wax, tree wax, and jojoba oil; animal wax, such as beeswax; ore/oil waxes, such as montan wax, ozokerite, ceresin, paraffin wax, microcrystalline wax, and Fischer Tropsch wax; and denatured products thereof.

These waxes can be easily processed to be fine particles of 1 $\mu$m or less by dispersing in water with a polymer electrolyte, such as an ionic surfactant, a polymeric acid, and a polymeric base, heating to the melting point or higher, and treating with a homogenizer capable of applying a strong shearing force or a pressure-discharge-type disperser.

Examples of interior additive include metals, such as ferrite, magnetite, reduced iron, cobalt, nickel, and manganese, alloys, and magnetic substances such as a compound containing metals.

Examples of the charge controller include a quaternary ammonium salt compound, a nigrosine-containing compound, dyes comprising a complex of aluminum, iron or chrome, and a triphenyl methane-containing pigment. It is preferable that a charge controlling agent of the present invention comprise a material not liable to dissolve in water in consideration of control of the ion strength, which influences stability upon aggregation or fusion, and reduction of waste water pollution.

Examples of inorganic particles include any particle usually applicable as an external additive of the toner surface, such as silica, alumina, titania, calcium carbonate, magnesium carbonate, calcium phosphate, cerium oxide, and the like.

Examples of the lubricant include aliphatic amides, such as ethylene bisstearylamide, and amide oleate, and aliphatic metal salts, such as zinc stearate, calcium stearate, and the like.

Examples of the abrasive include silica, alumina, cerium oxide, and the like.

An average particle size of other components is, in general, 1 $\mu$m or less, and preferably 0.01 to 1 $\mu$m. An average particle size of other component exceeding 1 $\mu$m causes a broader particle size distribution of a toner for developing an electrostatic charge image finally obtained or generates free radical particles, and thus easily causes deterioration of performance or reliability. On the other hand, an average particle size within the above-mentioned range eliminates the above-mentioned problems, toners can be spread more evenly so that the state of dispersion in the toners is improved, and thus it is advantageous in that irregular performance or reliability is alleviated. The average particle size may be measured with a Coulter counter.

As the dispersion medium for the above-mentioned dispersion, an aqueous medium can be presented. Examples of the aqueous medium include water, such as distilled water and ion exchanged water, and alcohols. These can be used alone or in combination of two or more.

In the present invention, it is preferable that a surfactant be added to and mixed with the aqueous medium.

Examples of the surfactant include anionic surfactants such as sulfate ester salt type, sulfonate type, phosphate type, and soap type; cationic surfactants such as amine salt type and quartenary ammonium salt type; nonionic type surfactants such as polyethylene glycol type, alkyl phenol ethylene oxide adduct type, and polyhydric alcohol type. Among these examples, anionic surfactants and cationic type surfactants are preferable. It is preferable that the nonionic type surfactants are used in combination with the anionic surfactant or the cationic surfactant. The surfactants may be used alone or in combination of two or more.

Examples of anionic surfactants include sodium dodecyl benzene sulfonate, sodium dodecyl sulfate, sodium alkyl naphthalene sulfonate, and sodium dialkyl sulfosuccinate. Examples of cationic surfactants include alkyl benzene dimethyl ammonium chloride, alkyl trimethyl ammonium chloride, and distearyl ammonium chloride.

Among these examples, ionic surfactants such as anionic surfactants and cationic surfactants are preferable.

The amount of the first resin particles in the dispersion is 40% or less by weight in the aggregative particle dispersion where the aggregative particles are formed, and is preferably 2 to 20% by weight.

If the colorant or magnetic substance is dispersed in the dispersion, the amount of the colorant in the dispersion is 50% or less by weight based on the aggregative particle dispersion where the aggregative particles are formed, and is preferably 2 to 40% by weight.

Furthermore, if other components are dispersed in the dispersion, the amount of other components is acceptable so long as it does not adversely affect the objects of the present invention. In general, it is quite small amount, namely, 0.01 to 5% by weight based on the aggregative particle dispersion where the aggregative particles are formed, and is preferably 0.5 to 2% by weight. If the amount is outside the above-mentioned range, properties may be deteriorated such as insufficient effect of dispersing the other particles or a wider particle size distribution.

The dispersion comprising at least first dispersed resin particles can be prepared as follows:

If the resin of the resin particle comprises a homopolymer or a copolymer of a vinyl-containing monomer (vinyl-containing resin), such as esters having a vinyl group, vinyl nitrites, vinyl ethers, and vinyl ketones, a dispersion where resin particles comprising a homopolymer or a copolymer of a vinyl containing monomer (vinyl-containing resin) dispersed in an ionic-type surfactant by the emulsion polymerization or the seed polymerization of the vinyl type monomer in the ionic-type surfactant.

If the resin particles comprises a resin other than a homopolymer or a copolymer of a vinyl-containing monomer and the resin dissolves in an oil-type solvent having a comparatively low solubility to water, the resin is dissolved in the oil type solvent and the solution is dispersed in water as fine particles with an ionic surfactant or a polymer electrolyte by a disperser such as a homogenizer, and the oil-type solvent is evaporated by heating or reducing pressure so as to obtain a dispersion where the resin particles of a resin other than a vinyl-type resin are dispersed in an ionic surfactant.

The means for dispersion is not specifically limited, and examples thereof include conventionally known dispersers, such as a rotation shearing homogenizer, a ball mill, a sand mill, and a dyno mill, which have media.

The aggregative particles are prepared as follows:

To a first dispersion comprising an aqueous medium added and mixed with a second ionic surfactant and at least the resin particles dispersed therein, a second ionic surfactant (I) having the polarity opposite to the first ionic surfactant, an aqueous medium (II) added and mixed therewith, or a second dispersion containing the aqueous medium (III) is mixed. By stirring the mixture liquid, according to the function of the first ionic surfactant, the resin particles are aggregated in the dispersion to form aggregative particles of the resin particles to obtain an aggregative particle dispersion.

It is preferable that the mixing procedure is conducted at a temperature of the glass transition point or lower of the resin contained in the mixture. By conducting the mixing procedure at this temperature, aggregation can take place stably.

The second dispersion comprises a dispersion where the resin particles, the colorant, and/or the other particles dispersed therein. The stirring procedure can be conducted with conventionally known stirring devices, homogenizers, and mixers.

In (I) or (II) above, aggregative particles of the resin particles dispersed in the first dispersion are formed.

The amount of the resin particles in the first dispersion is, in general, 5 to 60% by weight, and is preferably 10 to 40% by weight. The amount of the aggregative particles in the aggregative particle dispersion upon forming the aggregative particles is, in general, 40% by weight or less.

In (III) above, if the particles dispersed in the second dispersion are the resin particles, the aggregative particles of the resin particles dispersed in the first dispersion are formed. On the other hand, if the particles dispersed in the second dispersion are the colorant and/or the other particles, aggregative particles of these and the resin particles dispersed in the first dispersion of hetero aggregation are formed. Furthermore, if the particles dispersed in the second dispersion are resin particles, the colorant, and/or the other particles, aggregative particles of the resin particles dispersed in the first dispersion are formed.

In this case, the amount of the resin particles in the first dispersion is, in general, 5 to 60% by weight, preferably 10 to 40% by weight. The amount of the resin particles, the colorant, and/or the other particles in the second dispersion is, in general, 5 to 60% by weight, preferably 10 to 40% by weight. If the amount is outside the range, the particle size distribution becomes wider and the properties may deteriorate. The amount of aggregative particles in the aggregative particle dispersion at aggregative particle formation is, in general, 40% or less by weight.

If the aggregative particles or adhered particles are formed, it is preferable to have the opposite polarities in the ionic surfactant contained in the dispersion to be added and the ionic surfactant contained in the dispersion to added, and change the balance of the polarities.

An average particle size of the aggregative particles to be formed is not specifically limited, and, in general, is controlled so as to be about the same as the average particle size of the toner for developing an electrostatic charge image to be obtained. The control can be easily conducted by optionally setting or changing the temperature and the conditions of stirring and mixing.

By the first step heretofore mentioned, aggregative particles having an average particle size about the same as the average particle size of the toner for developing an electrostatic charge image are formed, and the aggregative particle dispersion where the aggregative particles are dispersed is prepared. The aggregative particles may be referred to as "mother particles" in the present invention.

Second step

The above-mentioned second step is a step in which adhered particles are formed by adding a resin-containing fine particle dispersion containing dispersed fine particles into the aggregative particle dispersion and mixing therewith so as to have the resin-containing fine particles adhere to the aggregative particles (the second step may be hereinafter referred to as an adhesion step).

The above-mentioned resin-containing fine particles are fine particles containing at least one kind of resin among the above-mentioned resins. Preferred examples of the resin used for forming the resin-containing fine particles are the same as those of the resin used for forming the above-mentioned resin particles.

On the other hand, in a toner production method using an emulsion polymerization aggregation method, in order to maintain excellent dispersibility of resin particles and to form stable aggregative particles, it is necessary that, in many cases, a dissociation group exists in a part of the polymeric monomer used for emulsion polymerization. However, if many dissociation groups exist on the surface of the finally obtained toner particles, the respective amounts by which the toner is charged in hot weather and in cold weather are greatly different due to absorption and removal of water of the dissociation group (i.e., the ratio of the amount by which the toner is charged becomes low). As a result, a so-called environment-dependent problem occurs and the stability of image quality is thereby affected. Further, in the third step described below, at the time of fusing due to heating at or above the glass transition point in a dispersion, the dissociation group is apt to impede fusing of the resin particles and the resin-containing fine particles, and as a result, unevenness is apt to remain on the surface of the toner particles. For this reason, it is sometimes necessary to have auxiliaries for maintaining high flowability and transfer efficiency of the toner. On the other hand, if the concentration of the dissociation group in a polymeric monomer used for emulsion polymerization is previously suppressed, control of average particle size during aggregation or stability of the average particle size during fusing deteriorate and it becomes difficult to obtain the toner having a target particle distribution.

Accordingly, in the present invention, the resin used for the above-mentioned resin-containing fine particles is selected so that the concentration of the second dissociation group per unit weight of the second resin-containing fine particles is lower than that of the first dissociation group per unit weight of the first resin particles contained in the aggregative particles.

As a result, the concentration of the dissociation group on the surface of the above-mentioned first resin particles is relatively high, and therefore, the aggregative particles can be easily formed and the particle size distribution thereof can be controlled. A coating film of the second resin-containing fine particles in which the concentration of the dissociation group per unit weight is lower than that of the dissociation group per unit weight is formed on the surface of the toner particles for developing an electrostatic charge image. For this reason, unlike the surface of the above-mentioned aggregative particles, absorption and removal of water is not easily caused. As a result, the toner particles for developing an electrostatic charge image allows facilitated cleaning and has an excellent charging property. Further, the characteristics of the toner particles, particularly the charging property, are not likely to vary with to environmental conditions.

On the other hand, unless the resin used for the resin-containing fine particles is selected as described above, relatively large numbers of dissociation groups remain on the surface of the toner particles for developing an electrostatic charge image. As a result, it is difficult to effect cleaning for the toner for developing an electrostatic charge image and absorption and removal of water is easily caused under normal conditions. For this reason, the charging property is easily affected by environment conditions.

In the present invention, the concentration of the dissociation group per unit volume is preferably set in the range of $0.1\times10^{-5}$ to $10.0\times10^{-5}$ mol/cm$^3$, and more preferably in the range of $0.5\times10^{-5}$ to $5.0\times10^{-5}$ mol/cm$^3$.

When the concentration of the dissociation group exceeds $10.0\times10^{-5}$ mol/cm$^3$, improvements in the charging property may not be sufficiently obtained even if a coating layer with the concentration of a dissociation group lower than that of the mother particles is formed. Further, when the concentration of the dissociation group is less than $0.1\times10^{-5}$ mol/cm$^3$, control of the particle size distribution may be difficult.

The concentration of the dissociation group can be basically determined from a prepared monomer composition. However, as described in document 1 ("Polymer Electrolyte—Polymer Experimentation 13" published by Kyoritu Shuppan), it can be determined by pH titration or conductometric titration.

In the case of the above-mentioned pH titration, a sample is dispersed in pure water so as to be formed as a free acid or base type sample through an ion exchange resin column and titration is carried out in an NaOH aqueous solution or in an HCl aqueous solution by using a pH meter. At this time, addition of about 0. 1N of a of a neutral salt such as NaCl allows a point of neutralization to be made clear.

Further, in order to determine the concentration of the density of the dissociation group in the particles from the surface to the inside, as described in document 2 ("Chemistry of Polymer Latex" published by Koubunshi Kanko Kai), it can be determined by melting from the surface of the particles. Namely, when the dissociation group is, for example, a carboxyl group, a resin having a carboxyl group, eluted due to gradual increase of the pH of the particle atmosphere, is separated by a centrifugal method or a gel filtration method. The concentration of the dissociation group may be determined by the above-mentioned method or the like.

The above-mentioned resin-containing fine particles in the second step are suitably used when, for example, a multicolored toner for developing an electrostatic charge image is produced. When the above-mentioned resin-containing fine particles are used, a layer of resin-containing fine particles is formed on the surface of the aggregative particles in which the above-mentioned resin particles and the above-mentioned colorant are caused to aggregate together. For this reason, the influence of the colorant upon charge behavior can be minimized so that the difference of the charging property caused by the kind of colorant is not easily made. Further, by selecting, as the resin of the resin-containing fine particles, a resin having a high glass transition point, compatibility between heat storing property and fixing property can be achieved and the toner for developing an electrostatic charge image having an excellent charging property can be produced accordingly.

An average particle size of the fine particles is, in general, 1 $\mu$m or less, and preferably 0.01 to 1 $\mu$m. An average particle size of the resin particles larger than 1 $\mu$m causes a broader particle size distribution of a toner for developing an electrostatic charge image finally obtained or generates free radical particles, and thus it easily causes deterioration of performance or reliability. On the other hand, an average particle size within the above-mentioned range eliminates the above-mentioned problems, and has the advantage of forming the layer structure by the fine particles. The average particle size may be measured with a Coulter counter.

The volume of the above-mentioned fine particles depends upon the volume percentage of the toner for developing an electrostatic charge image to be obtained, and it is preferably 50% or less of the volume of the toner for developing an electrostatic charge image to be obtained. If the volume of the fine particles exceeds 50% of the volume of the toner for developing an electrostatic charge image to be obtained, the fine particles do not adhere to the adhered particles or do not aggregate so that new aggregative particles of the fine particles are formed to cause significant change in the composition distribution or the particle size distribution of the toner for developing an electrostatic charge image to be obtained, and thus desired properties may not be obtained.

In the fine particle dispersion, one type of these resin-containing fine particles may be dispersed alone or can be dispersed in a combination of two or more. In the latter case, combinations of the resin-containing fine particles are not specifically limited, and can be optionally selected according to the purpose.

As a dispersion medium in the resin-containing fine particle dispersion, the above-mentioned aqueous medium can be presented. In the present invention, it is preferable that at least one from the above-mentioned surfactants is added and mixed with the above-mentioned aqueous medium.

The amount of the resin-containing fine particles in the resin-containing fine particle dispersion is, in general, 5 to 60% by weight, preferably 10 to 40% by weight. If the amount is outside the above-mentioned range, the structure and the composition of the toner for developing an electrostatic charge image from the inside to the surface may not be sufficiently controlled. The amount of the aggregative particles in the aggregative particle dispersion at the time of the aggregative particle formation is, in general, 40% or less by weight.

The above-mentioned resin-containing fine particle dispersion can be prepared by dispersing at least one type of the above-mentioned resin-containing fine particles to an aqueous medium added and mixed with an ionic surfactant. Furthermore, it is prepared by mechanical shearing or electric adsorption or fixation on the surface of latex produced in the emulsion polymerization or the seed polymerization.

The fine particle dispersion comprising the above-mentioned complex fine particles are prepared by dissolving at least one from the above-mentioned resins and at least one from the above-mentioned pigments in the above-mentioned solvent, and dispersing the solution in water as fine particles with an ionic surfactant or a polymer electrolyte with a disperser such as a homogenizer, and eliminating the solvent by evaporating by heating or reducing pressure. Furthermore, it is prepared by mechanical shearing or electric adsorption or fixation on the surface of latex produced in the emulsion polymerization or the seed polymerization.

In the second step, adhered particles are formed by adding and mixing the resin-containing fine particle dispersion in the aggregative particle dispersion prepared in the first step and adhering the fine particles on the aggregative particles.

Since the resin-containing fine particles are added to the aggregative particles, the resin-containing fine particles may be referred to as "added particles" in the present invention.

The adding and mixing method is not specifically limited, and thus the procedure can be conducted gradually and continuously or can be conducted in stages divided in a plurality of times. By adding and mixing the resin-containing fine particles (added particles), generation of minute particles can be suppressed, and thus a sharp particle distribution of the toner for developing an electrostatic charge image to be obtained can be ensured.

By conducting the adding and mixing procedure in stages divided in a plurality of times, layers of the above-mentioned resin-containing fine particles are laminated on the surface of the above-mentioned aggregative particles in stages, and thus structure change or composition gradient can be provided from the inside to the outside of the particles of the toner for developing an electrostatic charge image. Therefore, surface hardness of the particles can be improved and the particle size distribution can be maintained at fusing in the third step and the change thereof can be restricted. Besides, the addition of a stabilizing agent such as a surfactant and a base or an acid for improving the stability at fusing is not required, or the addition amount thereof can be curbed to the minimum level, and thus it is preferable in that cost reduction and quality improvement can be achieved.

Conditions of adhering the above-mentioned resin-containing fine particles on the above-mentioned aggregative particles are as follows:

The temperature of the glass transition point of the resin of the resin particles in the first step or lower, and about room temperature is preferable. By heating at the temperature of the glass transition point or lower, the above-mentioned aggregative particles and the above-mentioned resin-containing fine particles are easily adhered, and the resulting adhered particles to be formed are easily stabilized.

Although the treatment time depends upon the above-mentioned temperature and thus cannot be strictly defined, it is, in general, five minutes to two hours.

In the above-mentioned adhesion, the dispersion containing the above-mentioned aggregative particles and the above-mentioned resin-containing fine particles may be left standing or may be stirred gently with a mixer. The latter case is more advantageous in that homogeneous adhered particles can be formed easily.

In the present invention, the number of times for the second step is conducted may be one or a plurality of times. For one time, only one layer of the above-mentioned resin-containing fine particles (added particles) is formed on the surface of the above-mentioned aggregative particles, whereas in the latter case, so long as two or more types of the above-mentioned resin-containing fine particle dispersions are provided, a plurality of layers of the above-mentioned resin-containing fine particles (added particles) contained in the resin-containing fine particle dispersions are formed successively on the surface of the above-mentioned resin-containing aggregative particles. Therefore, the latter case is advantageous in that a toner for developing an electrostatic charge image having a complicated and precise hierarchial structure so that a desired function can be provided for the toner for developing an electrostatic charge image.

If the second step is conducted for a plurality of times, any combination of the resin-containing fine particles to be adhered first and the resin-containing fine particles to be adhered in the later stages can be used, and can be optionally selected according to the application of the toner for developing an electrostatic charge image and the purpose.

If the second step is conducted for a plurality of times, it is preferable to heat the dispersion containing the above-mentioned resin-containing fine particles and the above-mentioned aggregative particles at a temperature of the glass transition point or less of the resin of the resin particles in the first step whenever the above-mentioned fine particles are added and mixed, and it is more preferable to increase the heating temperature stepwise. It is advantageous in that generation of free radical particles can be restrained.

The above-mentioned second step(s) can produce adhered particles formed by adhering the above-mentioned resin-containing fine particles on the aggregative particles prepared in the first step. If the second step is repeated, adhered particles where the above-mentioned resin-containing fine particles are adhered for the plurality of times on the aggregative particles prepared in the first step are formed. Accordingly, by adhering resin-containing fine particles optionally selected to the above-mentioned aggregative particles in the second step, a toner for developing an electrostatic charge image having desired properties can be freely designed and produced.

Third Step

The above-mentioned third step is a step in which the above-mentioned adhered particles are heated and fused (the third step may be hereinafter referred to as a fusing process).

A temperature for heating may be from the glass transition point temperature of the resin contained in the adhered particles to the decomposition temperature of the resin. Therefore, the above-mentioned heating temperature varies depending upon the type of resin of the above-mentioned resin particles and the above-mentioned resin-containing fine particles, and thus cannot be defined as a whole. However, it is, in general, from the glass transition point temperature of the resin contained in the adhered particles to 180° C.

The heating procedure can be conducted with a conventionally known heating device or equipment.

As a duration of the above-mentioned fusion, a short duration may be sufficient if the above-mentioned heating temperature is high, and a long duration is necessary if the above-mentioned heating temperature is low. That is, since the above-mentioned heating duration depends upon the above-mentioned heating temperature, it cannot be defined as a whole; however, it is, in general, from 30 minutes to 10 hours.

In the present invention, it is possible to wash or dry a toner for developing an electrostatic charge image obtained after finishing the third step in optional conditions. It is also possible to add inorganic particles such as silica, alumina, titania, and calcium carbonate or resin particles such as a vinyl-containing resin, a polyester resin, and a silicone resin to the surface of the obtained toner for developing an electrostatic charge image while applying a shearing force in the dry state. These inorganic particles and the resin particles function as an external additive of the flowability auxiliary and the cleaning auxiliary.

The above-mentioned third step, wherein the adhered particles prepared in the second step are fused with the state where the above-mentioned resin-containing fine particles (added particles) are adhered to the surface of the above-mentioned aggregative particles (mother particles), can produce a toner for developing an electrostatic charge image.

Toner for Developing Electrostatic Charge Image

A toner for developing an electrostatic charge image of the present invention is obtained by the above-mentioned production method of a toner for developing an electrostatic charge image of the present invention.

The above-mentioned toner for developing an electrostatic charge image has a structure in which the above-mentioned aggregative particles as mother particles having the surface thereof coated with a layer of resin-containing fine particles in which concentration of a dissociation group per unit weight thereof is lower than that of a dissociation group per unit volume of resin particles contained in the mother particles. The above-mentioned resin-containing fine particle layer may comprise one layer or two or more layers. The number of layers is the same as the number of times the above-mentioned second step(s) is conducted.

The above-mentioned toner for developing an electrostatic charge image has a structure where the composition and physical properties change from the inside to the surface continuously or discontinuously, the change is controlled in a desired range, and furthermore, the concentration of the dissociation group per unit volume of the surface coating layer is lower than that of the concentration of the dissociation group per unit volume of the mother particles therein. For this reason, excellent characteristics including the charging property, developing property, transfer property, fixing property, and cleaning property are provided, and particularly, the charging property is excellent. Moreover, since the above-mentioned characteristics, particularly, the charging property are stably exhibited and maintained without being affected by environmental conditions, reliability is high.

Since the above-mentioned toner for developing an electrostatic charge image is produced in the above-mentioned production method of a toner for developing an electrostatic charge image of the present invention, unlike being produced in a kneading and pulverizing method, a small average particle size can be provided with a sharp particle distribution.

The above-mentioned average particle size is preferably 2 to 9 $\mu$m, and more preferably 3 to 8 $\mu$m. An average particle size smaller than 2 $\mu$m may easily cause insufficient charge property to decline the developing property, on the other hand, an average particle size larger than 9 am may worsen the resolution property of an image.

As an index for the above-mentioned particle size distribution, using D 16 and D84 of the cumulative distribution, a volume GSD (volume GSD=(volume D84/volume D16)$^{0.5}$) or a numerical GSD (numerical GSD=(numerical D84/numerical D16)$^{0.5}$) can be used easily and conveniently. The above-mentioned volume GSD is preferably 1.30 or less, and more preferably 1.27 or less.

If the above-mentioned volume GSD exceeds 1.30, the developing property may deteriorate over time according to the selected development.

An amount of the above-mentioned toner for developing an electrostatic charge image to be charged is preferably 10 to 40 $\mu$C/g, and more preferably 15 to 35$\mu$C/g. If the amount of the toner is less than 10 $\mu$C/g, background stains develop more easily. On the other hand, if the amount of the toner is more than 40 $\mu$C/g, image density reduction occurs.

The ratio of the respective amount of the toner for developing an electrostatic charge image to be charged in summer condition and winter condition is preferably 0.5 to 1.5, and more preferably 0.7 to 1.3. The ratio outside the preferred range may cause large environmental dependency of the toner and may thereby lack in stability of the charging property, which is not preferable in practice.

Electrostatic Charge Image Developer

An electrostatic charge image developer of the present invention comprises a toner for developing an electrostatic charge image of the present invention and a carrier.

The above-mentioned carrier is not specifically limited, and conventionally-known carriers can be used. Examples thereof include the carriers disclosed in JP-A Nos. 62-39879 and 56-11461.

The mixing ratio of a toner for developing an electrostatic charge image of the present invention and a carrier in the above-mentioned electrostatic charge image developer is not specifically limited and can be selected optionally according to the purpose.

Image Formation Method

An image formation method of the present invention comprises an electrostatic latent image formation step, a toner image formation step, and a transfer step. The above-mentioned steps are general steps disclosed in JP-A Nos. 56-40868 and 49-91231. An image formation method of the present invention can be implemented in conventionally-known image formation devices such as copy machines and facsimiles.

The above-mentioned electrostatic latent image formation step is a step in which an electrostatic latent image is formed on an electrostatic latent image holding member. The above-mentioned toner image formation step is a step in which the above-mentioned electrostatic latent image is developed by a developer layer on a developer carrying member to form a toner image. The above-mentioned developer layer is not specifically limited as long as it contains an electrostatic charge image developer of the present invention. The above-mentioned transfer step is a step in which the above-mentioned toner image is transferred on a transfer body.

In an image formation method of the present invention, an embodiment further comprising a cleaning step and a recycling step is preferable.

The above-mentioned cleaning step is a step in which an excess amount of the toner for developing an electrostatic charge image upon forming toner image is recollected. The above-mentioned recycling step is a step in which the collected toner in the above-mentioned cleaning step is transferred to the developer layer.

An image formation step of an embodiment comprising a cleaning step and a recycling step can be implemented in a toner recycle system type image formation device, such as a copying machine and a facsimile. It can be also applied to a recycle system of an embodiment where a toner is collected while developing without a cleaning step.

EXAMPLES

Example 1

First step

| -- Preparation of dispersion (1) -- | |
|---|---|
| styrene | 370 g |
| n-butyl acrylate | 30 g |
| acrylic acid | 4 g |
| dodecane thiol | 24 g |
| carbon tetrabromide | 4 g |

The above-mentioned materials were mixed and dissolved and added to a solution prepared by dissolving 6 g of a nonionic surfactant (Nonipol 400, manufactured by Sanyo Chemical Industries, Ltd.) and 10 g of an anionic surfactant (Neogen SC, manufactured by Daiichi Kogyo Seiyaku Co., Ltd.) to 550 g of ion exchanged water, dispersed, and emulsified in a flask. A solution prepared by dissolving 4 g of ammonium persulfate in 50 g of ion exchanged water was added thereto while slowly mixing for 10 minutes. After substituting nitrogen, the content of the flask was heated in an oil bath to 70° C. while stirring, and left for emulsion polymerization for 5 hours.

As a result, a dispersion (1) of resin particles, having an average particle size of 170 nm, a glass transition point of 58° C., a weight-average molecular weight (Mw) of 15,000 was prepared.

| -- Preparation of dispersion (2) -- | |
|---|---|
| styrene | 280 g |
| n-butyl acrylate | 120 g |
| acrylic acid | 8 g |

The above-mentioned materials were mixed and dissolved and added to a solution prepared by dissolving 6 g of a nonionic surfactant (Nonipol 400, manufactured by Sanyo Chemical Industries, Ltd.) and 12 g of an anionic surfactant (Neogen SC, manufactured by Daiichi Kogyo Seiyaku Co., Ltd.) to 550 g of ion exchanged water, dispersed, and emulsified in a flask. A solution prepared by dissolving 3 g of ammonium persulfate in 50 g of ion exchanged water was added thereto while slowly mixing for 10 minutes. After substituting nitrogen, the content of the flask was heated in an oil bath to 70° C. while stirring, and left for emulsion polymerization for 5 hours. As a result, dispersion (2) of resin particles, having an average particle size of 105 nm, a glass transition point of 53° C., Mw 550,000 was prepared.

| -- Preparation of colorant dispersion (1) | |
|---|---|
| carbon black (Mogul L, manufactured by Cabot Co., Ltd.) | 50 g |
| nonionic surfactant (Nonipol 400, manufactured by Sanyo Chemical Industries, Ltd.) | 5 g |
| ion exchanged water | 200 g |

The above-mentioned materials were mixed, dissolved and dispersed for 10 minutes by a homogenizer (Ultratalax, manufactured by IKA Co., Ltd.) to prepare colorant dispersion (1) of a colorant (carbon black), having an average particle size of 250 nm.

| -- Preparation of a mold release agent dispersion (1) -- | |
|---|---|
| paraffin wax (HNP0190, melting point: 85° C.; manufactured by Nihon Seirou Co., Ltd.) | 50 g |
| cationic surfactant (Sanisol B50, manufactured by Kao Co., Ltd.) | 5 g |
| Ion exchanged water | 200 g |

The above-mentioned materials were heated to 95° C., dispersed by a homogenizer (Ultratalax T50, manufactured by IKA Co., Ltd.), and then applied with a dispersion treatment by a pressure discharge type homogenizer to prepare mold release agent dispersion (1) of a mold release agent, having an average particle size of 550 nm.

| -- Preparation of aggregative particles -- | |
|---|---|
| dispersion (1) | 120 g |
| dispersion (2) | 80 g |
| colorant dispersion (1) | 30 g |
| mold release agent dispersion (1) | 40 g |
| cationic surfactant (Sanisol B50, manufactured by Kao Co., Ltd.) | 1.5 g |

The above-mentioned material were mixed and dispersed in a round-type stainless steel flask by a homogenizer (Ultratalax T50, manufactured by IKA Co., Ltd.), and heated to 48° C. in an oil bath while stirring. After maintaining at 48° C. for 30 minutes, it was confirmed that aggregative particles (volume: 95 $cm^3$) having an average particle size of about 5 $\mu$m were formed by the observation with an optical microscope.

The concentration of the carboxyl group acting as a dissociation group in the acrylic acid contained in the aggregative particles per unit volume is $3.1\times10^{-5}$.

Second step

Preparation of adhered particles 60 g of dispersion (1) as a resin-containing fine particle dispersion was slowly added thereto. The volume of the resin particles contained in the above-mentioned dispersion (1) was 25 $cm^3$. The temperature of the heating oil bath was increased to 50° C. and maintained for 1 hour.

It was confirmed that adhered particles having an average particle size of about 5.7 $\mu$m were formed by the observation with an optical microscope.

The concentration of the carboxyl group acting as a dissociation group contained in the surface layer of the adhered particles per unit volume is $2.2\times10^{-5}$.

Third step 3 g of an anionic surfactant (Neogen SC, manufactured by Daiichi Kogyo Seiyaku Co., Ltd.) was added thereto, and the stainless steel flask was sealed tightly. While stirring with a magnetic seal, it was heated to 105° C. and maintained for 3 hours.

After cooling, the reaction product was filtered, washed sufficiently with ion exchanged water, and dried to obtain a toner for developing an electrostatic charge image.

Evaluation

The average particle size of the obtained toner for developing an electrostatic charge image measured with a Coulter counter was 5.8 $\mu$m. The volume GSD, which is an index of the volume particle size distribution, was 1.25. The surface state was observed with an electron microscope. Exposure of a wax-like substance on the surface of the toner for developing an electrostatic charge image was slight, and separated wax-like substance was not observed.

The toner for developing an electrostatic charge image was mixed with a ferrite carrier having an average particle size of 50 $\mu$m, coated with 1% of polymethyl methacrylate (manufactured by Soken Kagaku) at a toner concentration of 5% by weight in a glass bottle, mixed with a ball mill for five minutes to produce an electrostatic charge image developer. The environmental condition during the above-mentioned mixing is provided as the hot season (30° C., relative humidity 85%) and the cold season (5° C., relative humidity 10%). After the above-mentioned mixing, the amount of the toner to be charged was measured by using a blow-off charge amount measuring machine manufactured by Toshiba Corporation. As a result, the toner for developing an electrostatic charge image indicates 28 $\mu$C/g in the hot season and 35 $\mu$C/g in the cold season, giving a high value ratio of 0.8. Accordingly, the obtained toner for developing an electrostatic charge image is excellent in charging property and in environmental stability.

Fixation of the toner for developing an electrostatic charge image was evaluated by rubbing with a cloth and modified V500 manufactured by Fuji Xerox, Co., Ltd. and a fastness tester. Sufficient fixing property was shown at a heat roller temperature of 130° C., and offset was not generated until 220° C.

Continuous operation test was conducted with the electrostatic charge image developer. An stable image was obtained after copying 10,000 sheets without generation of filming on a photoreceptor.

Comparative Example 1

| -- Preparation of dispersion (3) -- | |
|---|---|
| styrene | 370 g |
| n-butyl acrylate | 30 g |
| acrylic acid | 8 g |
| dodecane thiol | 24 g |
| carbon tetrabromide | 4 g |

The above-mentioned materials were mixed and dissolved and added to a solution prepared by dissolving 6 g of a nonionic surfactant (Nonipol 400, manufactured by Sanyo Chemical Industries, Ltd.) and 10 g of an anionic surfactant (Neogen SC, manufactured by Daiichi Kogyo Seiyaku Co., Ltd.) to 550 g of ion exchanged water, dispersed, and emulsified in a flask. A solution prepared by dissolving 4 g of ammonium persulfate in 50 g of ion exchanged water was added thereto while slowly mixing for 10 minutes. After substituting nitrogen, the content of the flask was heated in an oil bath to 70° C. while stirring, and left for emulsion polymerization for 5 hours.

As a result, a dispersion (3) of resin particles, having an average particle size of 165 nm, a glass transition point of 57° C., a weight-average molecular weight (Mw) of 13,400 was prepared.

| | |
|---|---|
| dispersion (3) | 120 g |
| dispersion (2) | 80 g |
| colorant dispersion (1) | 30 g |
| mold release agent dispersion (1) | 40 g |
| cationic surfactant (Sanisol B50, manufactured by Kao Co., Ltd.) | 1.5 g |

The above-mentioned materials were mixed and dispersed in a round-type stainless steel flask with a homogenizer (Ultratalax T50, manufactured by IKA Co., Ltd.), and heated to 48° C. in an oil bath while stirring. After maintaining the materials at 48° C. for 90 minutes, it was confirmed by light microscope that aggregative particles (volume: 94 $cm^3$) having an average particle size of about 5.2 $\mu$m were formed.

The concentration of a carboxyl group as a dissociation group in acrylic acid contained in the aggregative particles per unit weight is $3.1\times10^{-5}$.

60 g of dispersion (3) was slowly added thereto. The volume of the resin particles contained in the above-mentioned dispersion (3) as the above-mentioned resin-containing fine particle dispersion was 24 $cm^3$. The temperature of the heating oil bath was increased to 50° C. and maintained for 1 hour.

It was confirmed by light microscope that adhered particles having an average particle size of about 5.8 $\mu$m were formed.

The concentration of the carboxyl group acting as the dissociation group contained on the surface layer of the adhered particles per unit volume is $3.1\times10^{-5}$, the same as that of the above-mentioned aggregative particles.

3 g of an anionic surfactant (Neogen SC, manufactured by Daiichi Kogyo Seiyaku Co., Ltd.) was added thereto, and the stainless steel flask was sealed tightly. While stirring with a magnetic seal, it was heated to 105° C. and maintained for 3 hours.

After cooling, the reaction product was filtered, washed sufficiently with ion exchanged water to obtain a toner.

Evaluation

The average particle size of the obtained toner measured with a Coulter counter was 6.0 $\mu$m. The volume GSD, which is an index of the volume particle size distribution, was 1.24. The surface state was observed with an electron microscope. Exposure of a wax-like substance on the surface of the toner for developing an electrostatic charge image was slight, and free wax-like substance was not observed.

The toner was mixed with a ferrite carrier having an average particle size of 50 $\mu$m, coated with 1% of polymethyl methacrylate (manufactured by Soken Kagaku) at a toner concentration of 5% by weight in a glass bottle, and mixed with a ball mill for five minutes to produce a developer. The environmental conditions during mixing were provided as the hot season (30° C., relative humidity 85%) and the cold season (5° C., relative humidity 10%). After mixing, the amount of charge was measured by using a blow-off charge amount measuring machine manufactured by Toshiba Corporation. As a result, the toner for developing an electrostatic charge image exhibited 15 $\mu$C/g in the hot season and 37 $\mu$C/g in the cold season. This gives a remarkably low ratio of 0.4. Accordingly, the obtained toner for developing an electrostatic charge image has insufficient environmental stability with respect to the charging property.

Fixation of the toner was evaluated by rubbing with a cloth and modified V500 manufactured by Fuji Xerox, Co., Ltd. and a fastness tester. Sufficient fixing property was shown at a heat roller temperature of 130° C., and offset was not generated until 230° C.

A continuous operation test was conducted with the above developer. After 10,000 copies, image density was slightly high, toner consumption was high, and dirt was observed on the image background portion during the supply of the toner.

Example 2

First step

| --Preparation of dispersion (4) -- | |
|---|---|
| styrene | 320 g |
| n-butyl acrylate | 80 g |
| acrylic acid | 8 g |
| dodecane thiol | 12 g |
| carbon tetrabromide | 4 g |

The above-mentioned materials were mixed and dissolved and added to a solution prepared by dissolving 6 g of a nonionic surfactant (Nonipol 400, manufactured by Sanyo Chemical Industries, Ltd.) and 10 g of an anionic surfactant (Neogen SC, manufactured by Daiichi Kogyo Seiyaku Co., Ltd.) to 550 g of ion exchanged water, dispersed, and emulsified in a flask. A solution prepared by dissolving 4 g of ammonium persulfate in 50 g of ion exchanged water was added thereto while slowly mixing for 10 minutes. After substituting nitrogen, the content of the flask was heated in an oil bath to 70° C. while stirring, and left for emulsion polymerization for 5 hours.

As a result, a dispersion (4) of resin particles, having an average particle size of 170 nm, a glass transition point of 50° C., a weight-average molecular weight (Mw) of 22,000 was prepared.

| -- Preparation of colorant dispersion (2) -- | |
|---|---|
| phthalocyanine pigment (manufactured by BASF Co., Ltd.) | 200 g |
| nonionic surfactant (Nonipol 400, manufactured by Sanyo Chemical Industries, Ltd.) | 5 g |
| ion exchanged water | 200 g |

The above-mentioned materials were mixed, dissolved, dispersed for 10 minutes by a rotor-stator-type homogenizer (Ultratalax, manufactured by IKA Co., Ltd.), and further dispersed for 5 minutes by a supersonic homogenizer to prepare a colorant dispersion (2) of a colorant (phthalocyanine pigments), having an average particle size of 150 nm.

| -- Preparation of aggregative particles -- | |
|---|---|
| dispersion (4) | 200 g |
| colorant dispersion (2) | 15 g |
| cationic surfactant (Sanisol B50, manufactured by Kao Co., Ltd.) | 2 g |

The above-mentioned material were mixed and dispersed in a round-type stainless steel flask by a homogenizer (Ultratalax T50, manufactured by IKA Co., Ltd.), and heated to 48° C. in an oil bath while stirring. After maintaining at 48° C. for 30 minutes, it was confirmed that aggregative particles (volume: 94 $cm^3$) having an average particle size of about 5.2 $\mu$m were formed by the observation with an optical microscope.

The concentration of the carboxyl group acting as a dissociation group in the acrylic acid contained in the aggregative particles per unit volume was $4.4\times10^{-5}$.

Second step

Preparation of adhered particles 60 g of dispersion (1) as a resin-containing fine particle dispersion was slowly added thereto. The volume of the resin particles contained in the above-mentioned dispersion (1) was 25 $cm^3$. The temperature of the heating oil bath was increased to 50° C. and maintained for 1 hour.

It was confirmed that adhered particles having an average particle size of about 5.5 $\mu$m were formed by the observation with an optical microscope.

The concentration of the carboxyl group as the dissociation group contained in the surface layer of the adhered particles per unit volume was $2.2\times10^{-5}$.

Third step 3 g of an anionic surfactant (Neogen SC, manufactured by Daiichi Kogyo Seiyaku Co., Ltd.) was added thereto, and the stainless steel flask was sealed tightly. While stirring with a magnetic seal, it was heated to 105° C. and maintained for 3 hours.

After cooling, the reaction product was filtered, washed sufficiently with ion exchanged water, and dried to obtain a toner for developing an electrostatic charge image.

Evaluation

The average particle size of the obtained toner for developing an electrostatic charge image measured with a Coulter counter was 5.6 $\mu$m. The volume GSD, which is an index of the volume particle size distribution, was 1.22.

The toner for developing an electrostatic charge image was mixed with a ferrite carrier having an average particle size of 50$\mu$m, and coated with 1% of polymethyl methacrylate (manufactured by Soken Kagaku) at a toner concentration of 5% by weight in a glass bottle, mixed with a ball mill for five minutes to produce an electrostatic charge image developer. The environmental conditions during mixing were provided as the hot season (30° C., relative humidity 85%) and the cold season (5° C., relative humidity 10%). After mixing, the amount of charge was measured by using a blow-off charge amount measuring machine manufactured by Toshiba Corporation. The toner for developing an electrostatic charge image exhibits 24 $\mu$C/g in the hot season and 26 $\mu$C/g in the cold season. This gives a high ratio of 0.92. Accordingly, the obtained toner for developing an electrostatic charge image is excellent in the charging property and in environmental stability.

On the other hand, the above toner for developing an electrostatic charge image was stored at 45 ° C. for 24 hours after being dried. No blocking was recognized. An image quality test was conducted with modified Acolor, manufactured by Fuji Xerox Co., Ltd. The flowability of the obtained toner was found to be excellent and a vivid cyan image with a high glossiness was obtained.

Comparative Example 2

A toner was obtained in the same way as in Example 2, in except that the resin-containing fine particle dispersion to be added in the second step was changed from dispersion (1) to dispersion (4).

The toner obtained has an average particle size of 5.8 $\mu$m and exhibits charge amounts of 8$\mu$C/g and 35 $\mu$C/g in the hot season and the cold season respectively. This gives a low ratio of 0.23. Accordingly, the obtained toner has insufficient charge property and environmental stability. Meanwhile, when the toner is stored at 45° C. for 24 hours after drying, one-third of the toner by weight is set in a blocking state.

Example 3

First step

| -- Preparation of dispersion (5) -- | |
|---|---|
| styrene | 370 g |
| n-butyl acrylate | 30 g |
| acrylic acid | 6 g |
| dodecane thiol | 24 g |
| carbon tetrabromide | 4 g |

The above-mentioned materials were mixed and dissolved and added to a solution prepared by dissolving 6 g of a nonionic surfactant (Nonipol 400, manufactured by Sanyo Chemical Industries, Ltd.) and 10 g of an anionic surfactant (Neogen SC, manufactured by Daiichi Kogyo Seiyaku Co., Ltd.) to 550 g of ion exchanged water, dispersed, and emulsified in a flask. A solution prepared by dissolving 4 g of ammonium persulfate in 50 g of ion exchanged water was added thereto while slowly mixing for 10 minutes. After substituting nitrogen, the content of the flask was heated in an oil bath to 70° C. while stirring, and left for emulsion polymerization for 5 hours.

As a result, a dispersion (5) of resin particles, having an average particle size of 150 nm, a glass transition point of 56° C., a weight-average molecular weight (Mw) of 14,000 was prepared.

| -- Preparation of aggregative particles -- | |
|---|---|
| dispersion (5) | 120 g |
| dispersion (2) | 80 g |

-continued

| -- Preparation of aggregative particles -- | |
|---|---|
| colorant dispersion (1) | 30 g |
| mold release agent dispersion (2) | 15 g |
| cationic surfactant (Sanisol B50, manufactured by Kao Co., Ltd.) | 1.5 g |

Meanwhile, as the above-mentioned mold release agent dispersion (2), polyethylene dispersion (W900, solid part 40%, manufactured by Mitsui Petrochemical Industries, Ltd.) was used.

The above-mentioned materials were mixed and dispersed in a round-type stainless steel flask with a homogenizer (Ultratalax T50, manufactured by IKA Co., Ltd.), and heated to 48° C. in an oil bath while stirring. After maintaining at 48° C. for 30 minutes, it was confirmed by high microscope that aggregative particles (volume: 97 $cm^3$) having an average particle size of about 5.5 μm were formed.

The concentration of the carboxyl group acting as the dissociation group in the acrylic acid contained in the aggregative particles per unit volume is $2.9\times10^{-5}$.

Second step

Preparation of adhered particles 60 g of dispersion (1) as a resin-containing fine particle dispersion was slowly added thereto. The volume of the resin particles contained in the above-mentioned dispersion (1) was 25 $cm^3$. The temperature of the heating oil bath was increased to 50° C. and maintained for 1 hour.

It was confirmed that adhered particles having an average particle size of about 6.1 μm were formed by the observation with an optical microscope.

The concentration of a carboxyl group acting as the dissociation group contained in the surface layer of the adhered particles per unit weight is $1.9\times10^{-5}$.

Third step 5 g of an anionic surfactant (Neogen SC, manufactured by Daiichi Kogyo Seiyaku Co., Ltd.) was added thereto, and the stainless steel flask was sealed tightly. While stirring with a magnetic seal, it was heated to 110° C. and maintained for 3 hours. After cooling, the reaction product was filtered, washed sufficiently with ion exchanged water to obtain a toner for developing an electrostatic charge image.

Evaluation

The average particle size of the obtained toner for developing an electrostatic charge image measured with a Coulter counter was 6.2 μm. The volume GSD, which is an index of the volume particle size distribution, was 1.26.

The toner for developing an electrostatic charge image was mixed with a ferrite carrier having an average particle size of 50 μm, coated with 1% of polymethyl methacrylate (manufactured by Soken Kagaku) at a toner concentration of 5% by weight in a glass bottle and mixed with a ball mill for five minutes to produce an electrostatic charge image developer. The environmental conditions during mixing were provided as the hot season (30° C., relative humidity 85%) and the cold season (5° C., relative humidity 10%). After the above-mentioned mixing, the amount of the toner charged was measured by using a blow-off charge amount measuring machine manufactured by Toshiba Corporation. The toner for developing an electrostatic charge image exhibits 25 μC/g in the hot season and 30 μC/g in the cold season. This gives a high ratio of 0.83. Accordingly, the toner obtained for developing an electrostatic charge image is excellent in charge property and in environmental stability.

A continuous operation test (5,000 copies in the hot season and 5,000 copies in the cold season) was conducted on the electrostatic charge image developer. A stable image was obtained after 10,000 copies. No generation of filming on the photoreceptor was observed.

The results are giving in Table 1 below.

TABLE 1

| | | Ex. 1 | Ex. 2 | Ex. 3 | Comp. Ex. 1 | Comp. Ex. 2 |
|---|---|---|---|---|---|---|
| average particle size of aggregative particles (μm) | | 5.0 | 5.2 | 6.1 | 5.2 | 5.2 |
| concentration of carboxyl group in aggregative particles (mol/$cm^3$) | | $3.1\times10^{-5}$ | $4.4\times10^{-5}$ | $2.9\times10^{-5}$ | $3.1\times10^{-5}$ | $4.4\times10^{-5}$ |
| type of resin-containing fine particle dispersion | | dispersion (1) | dispersion (1) | dispersion (1) | dispersion (3) | dispersion (4) |
| average particle size of adhered particles (μm) | | 5.7 | 5.5 | 6.1 | 5.8 | 5.5 |
| concentration of carboxyl group in adhered particles (mol/$cm^3$) | | $2.2\times10^{-5}$ | $2.2\times10^{-5}$ | $1.9\times10^{-5}$ | $3.1\times10^{-5}$ | $4.4\times10^{-5}$ |
| average particle size of toner (μm) | | 5.8 | 5.6 | 6.2 | 6.0 | 5.8 |
| volume GSD | | 1.25 | 1.22 | 1.26 | 1.24 | 1.22 |
| amount of charge | hot season (μC/g) | 28 | 24 | 25 | 15 | 8 |
| | cold season (μC/g) | 35 | 26 | 30 | 37 | 35 |
| ratio of amount of charge | | 0.80 | 0.92 | 0.83 | 0.40 | 0.23 |

Notes:
Ex. = Example
Comp. Ex. = Comparative example.

Example 4

With the electrostatic charge image developer obtained in Example 1, and a developing machine produced by modifying the developing machine used in Example 1 to a toner recycle system type where toner collected from the cleaner portion is returned to the developing machine, a stable image was obtained after 10,000 copies and generation of filming on a photoreceptor was not observed.

Example 5

With the electrostatic charge image developer obtained in Example 1, and a copier produced by modifying the copier used in Example 1 to a cleanerless system type where a cleaner is removed, a stable image was obtained after 5,000 copies and generation of fogging was not observed.

What is claimed is:

1. A production method of a toner for developing an electrostatic charge image comprising the steps of:

forming aggregative particles in a first dispersion including at least first dispersed resin particles to prepare an aggregative particle dispersion;

adding a resin-containing fine particle dispersion containing second dispersed resin-containing fine particles into said aggregative particle dispersion and mixing therewith to form adhered particles having said resin-containing fine particles adhering to said aggregative particles; and heating and thereby fusing said adhered particles wherein concentration of a second dissociation group of said second resin-containing fine particles per unit volume is lower than that of a first dissociation group of said first resin-containing fine particles per unit volume.

2. A production method of a toner for developing an electrostatic charge image according to claim 1, wherein the first and second dissociation groups are independently selected from a carboxyl group, a sulfonic group, and an ammonium group.

3. A production method of a toner for developing an electrostatic charge image according to claim 1, wherein the first resin particles and the second resin-containing fine particles each include a vinyl type resin.

4. A production method of a toner for developing an electrostatic charge image according to claim 1, wherein the first resin particles and the second resin-containing fine particles each include a vinyl type polymeric acid as a monomer component.

5. A production method of a toner for developing an electrostatic charge image according to claim 1, wherein the second resin-containing fine particles have a glass transition point higher than that of the first resin particles.

6. A production method of a toner for developing an electrostatic charge image according to claim 1, wherein the aggregative particles include a colorant.

7. A production method of a toner for developing an electrostatic charge image according to claim 1, wherein the aggregative particles include a mold release agent.

8. A production method of a toner for developing an electrostatic charge image according to claim 1, wherein the first resin particles and the second resin-containing fine particles each have an average particle size of 1 $\mu$m or less.

9. A production method of a toner for developing an electrostatic charge image according to claim 1, wherein the volume of the second resin-containing fine particles is 50% or less of that of the toner particles for developing an electrostatic charge image.

10. A toner for developing an electrostatic charge image, obtained by the production method of a toner for developing an electrostatic charge image according to claim 1.

11. An image formation method comprising the steps of:

forming an electrostatic latent image on an electrostatic latent image holding member;

developing the electrostatic latent image through a developer layer on a developer carrying member to form a toner image; and transferring the toner image on a transfer body, wherein the developer layer comprises the toner for developing an electrostatic image according to claim 10.

12. An image formation method according to claim 11, further comprising a cleaning step in which toner remaining on the electrostatic latent image holding member is collected after the transfer step.

13. An image formation method according to claim 12, further comprising a recycling step in which the toner for developing an electrostatic charge image collected in the cleaning step is transferred to the developer layer.

* * * * *